US005165511A

United States Patent [19]

Lorenzo Regidor

[11] Patent Number: 5,165,511

[45] Date of Patent: Nov. 24, 1992

[54] FRAME-HOLDER FOR COIN OR TOKEN VALIDATION DEVICES

[75] Inventor: Angel Lorenzo Regidor, Barcelona, Spain

[73] Assignee: Industrias Lorenzo, S.A., Barcelona, Spain

[21] Appl. No.: 710,021

[22] Filed: Jun. 5, 1991

[30] Foreign Application Priority Data

Jun. 5, 1990 [ES] Spain ..... 9001540
Feb. 7, 1991 [ES] Spain ..... 9100327

[51] Int. Cl.[5] ..... G07F 1/04

[52] U.S. Cl. ..... 194/345; 194/350; 194/344

[58] Field of Search ..... 194/344, 345, 350, 221, 194/227

[56] References Cited

U.S. PATENT DOCUMENTS

| | | | |
|---|---|---|---|
| 2,237,132 | 4/1941 | Christensen | 194/344 X |
| 2,539,855 | 1/1951 | Nelson | 194/344 X |
| 3,156,340 | 11/1964 | Arkes | 194/344 X |
| 3,907,088 | 9/1975 | Burzen | 194/346 X |
| 4,583,630 | 4/1986 | Kalishman | 194/344 X |
| 4,651,862 | 3/1987 | Greenfield, Jr. | 194/344 |
| 4,911,280 | 3/1990 | Bruner | 194/344 X |
| 5,048,663 | 9/1991 | Abe | 194/346 X |

FOREIGN PATENT DOCUMENTS

| | | | |
|---|---|---|---|
| 3727927 | 3/1989 | Fed. Rep. of Germany | 194/350 |
| 268966 | 3/1982 | Spain . | |
| 8700623 | 2/1988 | Spain . | |

*Primary Examiner*—Michael S. Huppert
*Assistant Examiner*—William M. Hienz
*Attorney, Agent, or Firm*—Jacobson, Price, Holman & Stern

[57] ABSTRACT

A holder for coin validation devices is comprised of a one piece injection molded body (1) of plastic material having therein a first inclined passage (29) for receiving coins or tokens above the validation device, a second passage (30) of rectangular cross section below the validation device for receiving accepted coins therefrom, a third passage of rectangular cross section (31) for receiving rejected coins or tokens and directing the rejected coins or tokens toward a return (32), side walls on the body (1) forming a prismatic rectangular recess (40) communicating with the three passages and having a width and depth and height sufficient to receive and house a validation device for coins and tokens, and a set of supplementary elements (51) of T-shaped cross section for selective insertion at one side of the second passage (30), the elements (51) having different sized ribs (54) for adjusting the coin gap in the second passage (30) for adapting the device to handle different size coins.

18 Claims, 3 Drawing Sheets

FIG. 1
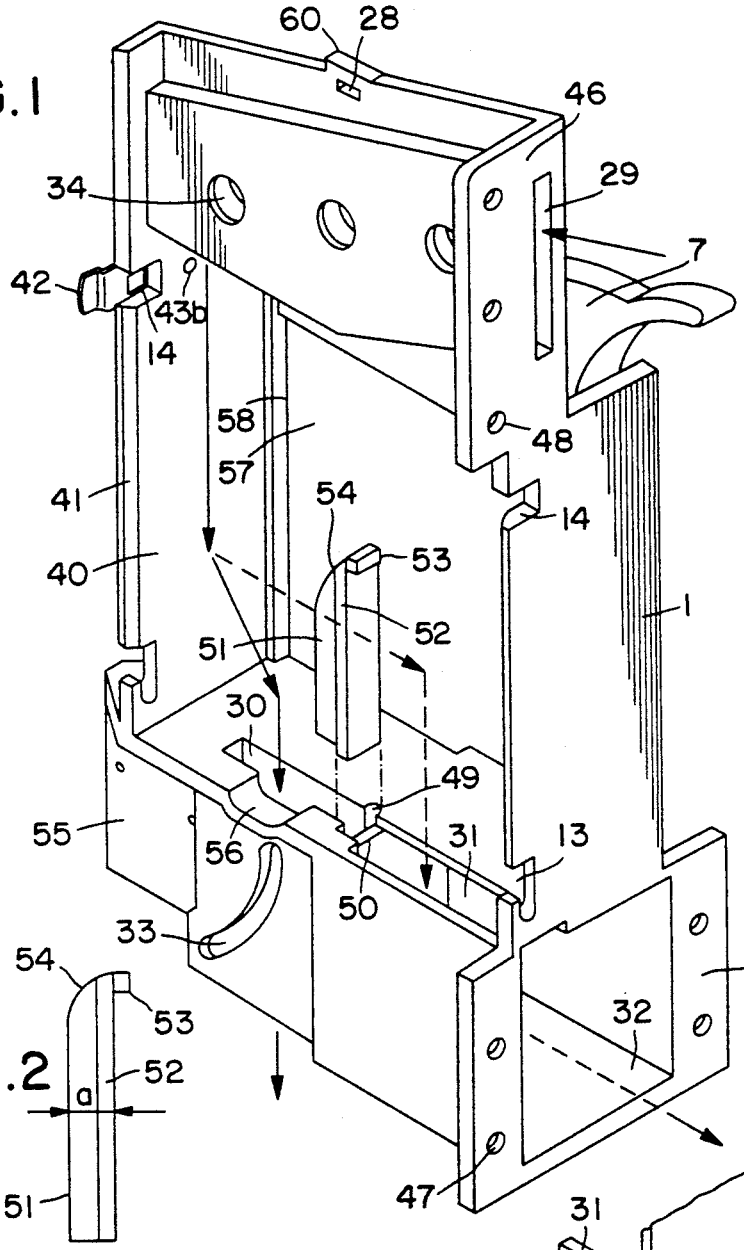
FIG. 2
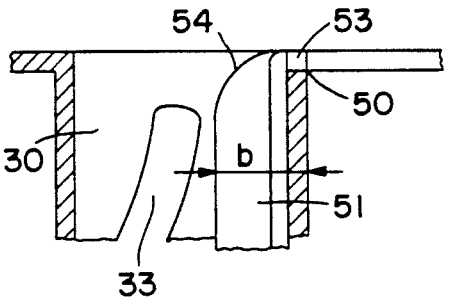
FIG. 3
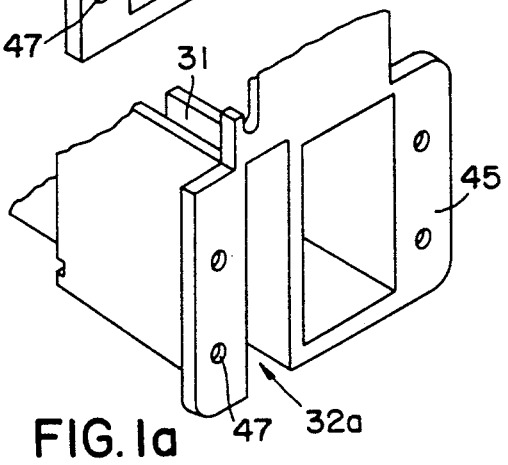
FIG. 1a

FRAME-HOLDER FOR COIN OR TOKEN VALIDATION DEVICES

BACKGROUND OF THE INVENTION

This invention relates to a frame holder for removably housing validation devices in coin-operated dispensing machines, amusement or gaming machines and automatic apparatus to cancel payment.

There are currently known several support means and frame holders for the above purpose, constituted by several parts made of metallic plate material, that are interrelated by a more or less complex assembling operation through screws, pins and slots, engageable with each other, directly opposite to each other, to house and retain a coin validation device body (using positioning pins in a side wall thereof cooperating with grooves and recesses defined in the support means) in a predetermined position, in such a way that a coin entrance communicates with a slot or path for passage of coins and differentiated exits facing a second acceptance path and a third rejecting path for directing coins or tokens toward an annexed recess to which the user has direct access. The paths for coins or token circulation are conformed by independent plate parts, that are made integral with those forming two sides of the coin validation device frame holder, or support part sides by conventional locking means.

The body frame or supporting members must incorporate in addition, integral therewith, a shaft to mount in rotating articulation an elastically loaded lever to feed back the defective coins, the lever being interrelated with a push button for such purpose and protruding from a front panel, on whose back is fixed the frame holder, and which operates on a hinged element that diverts the jammed coins or tokens toward a rejecting path.

Spanish Utility Model No. 268.966 and Spanish Application No. 87 00623 relate to the above type of device.

Due to the number of component parts, the manufacture of the support or frame holders is expensive and its interrelation with the panel where it defines the coin entrance slot is also a complicated task, in order to guarantee that the assembly can operate correctly without errors by incidental deformations in some of its parts.

BRIEF SUMMARY OF THE INVENTION

In order to simplify the manufacture of such frame holders, the invention proposes essentially to construct the assembly with only a single body obtained by an injection molding operation and therefore of a material that can be used through such a process, advantageously of plastic material, in which are integrated not only the means forming its own support, but also the path for the entering of the coins, exit path and reject or feeding back path, a supporting shaft to install a lever that operates a feeding back device to release jammed coins or tokens, and a support for detecting means and illumination of a push-button to operate the lever.

This single body has formed therein a first inclined path or channel of rectangular cross section for receiving the inserted coins or tokens, and that ends in a slotted path which remains level to one of the side walls of a large prismatic rectangular recess of a width and depth big enough to house the body of any type of coin validation device (mechanical, electromechanical, etc.), the recess having in the wall close to the slotted path, extending from this opening to the opposite side, a large aperture through which extends parallel to the recess back side an appendage from which perpendicularly protrudes a cylindrical stem or shaft. The recess has an opening to ease the mounting of the lever to feed back the jammed coins or tokens. The stem or shaft has a first thicker part, to support a spring forming a loop and extended in two divergent arms, one of the arms being supported on one of the recess side walls and the second arm latching to one part of the lever.

On the side part of the recess opposite to the coin or token entrance path, there are two slotted, co-aligned adjacent openings, having different sizes that communicate with the perpendicular coin acceptance path and with a box or path to feed back the defective coins or tokens.

The recess side edges have close to the smaller sides thereof grooves and notches opposite to each other for positioning and retaining by an elastic element the validation device body inside the prismatic recess. In the grooves of rectangular profile and notches of L-shaped profile, are introduced shafts on the sides of the validation device and one of them forces an elastic element whose end, having an elbowed shaped profile, remains arranged inside one of the rectangular grooves, until the shaft passes a ramp thereon and enters the groove remaining trapped by the elastic element on the side wall.

On one of the sides of the slot for insertion of the coins and flanking the feeding back box opening the single body holder has flanges provided with mounting holes to mount the holder to an assembly panel.

Another characteristic of the invention is the fact that the coin or tokens entrance path has aligned cross holes. These holes though used during the manufacturing process of the path for immobilizing and perfect centering of a slide required in the mold have in addition the function to make possible in a simple way the withdrawal of coins, tokens or other objects that become trapped in the path.

Furthermore, one of the walls forming the coin entrance oblique path is continued above the path and has a protrusion of triangular profile with an offset on one of the wall sides to mount an illumination bushing provided with an anchoring clip.

The single body holder will be advantageously obtained as stated by means of an injection molding operation with the assistance of three slides to form the three paths, two of them parallel and the third one oblique and longer and centered during the process by positioning means that will later on give rise to the mentioned centered holes.

The coin acceptance path also has an arch-shaped cross passageway to facilitate arranging across it a rod interrelated with a microswitch to record the number of coins or tokens accepted. The recess side wall extends beyond the slot preventing access to the rod from the feeding back box, whose wider slot remains virtually level with the recess edge.

The coin acceptance path has furthermore, close to one of its sides, upright grooves, facing each other, for guided insertion and setting of supplementary elements, designed to throttle the coin passageway to adapt it to the physical characteristics of the coins or tokens under test in the validation device. For such purpose a set of supplementary elements of different dimensions are selectively insertable within the coin acceptance path.

BRIEF DESCRIPTION OF THE DRAWINGS

The invention will now be described in detail with reference to the accompanying drawings wherein:

FIG. 1 is a perspective view of the frame holder of the invention with a detail of one of the supplemental elements designed to reduce the passageway width of the coin acceptance path as positioned prior to its inserting in said path;

FIG. 1*a* is a fragmentary view of an alternative embodiment of the rejecting path for defective or jammed coins or tokens.

FIG. 2 is a side elevation view of the supplemental element shown in FIG. 1 whose width is represented by the reference a;

FIG. 3 is a fragmentary cross section of the coin acceptance path with supplemental reducing part, of a span different from that of FIG. 2, marked with reference b;

DETAILED DESCRIPTION

Figure 4:
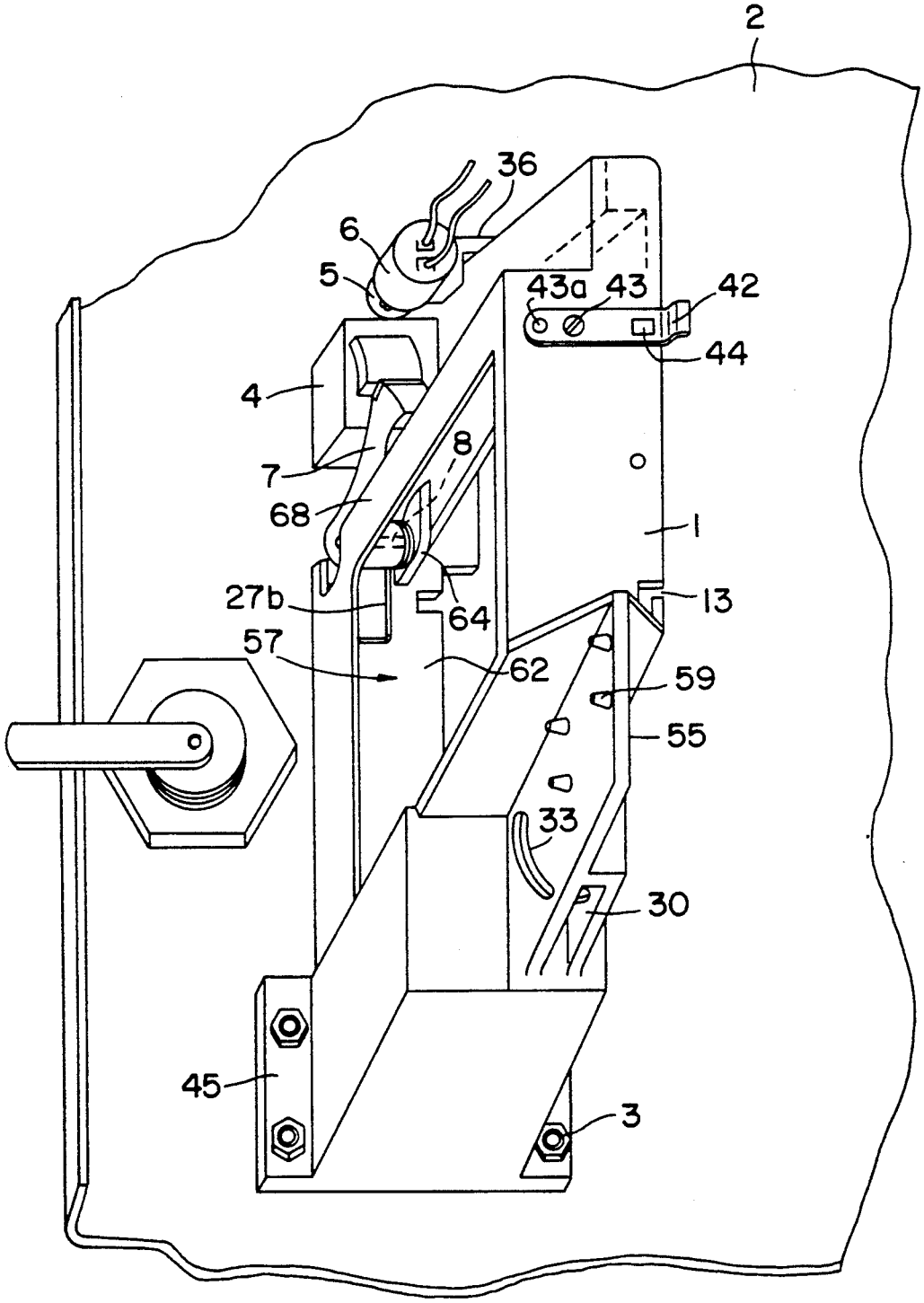
FIG. 4 is a perspective view opposite to that of FIG. 1 of the frame holder of the invention, in a normal mounting position, locked to a door or panel.

With reference to FIG. 1, the frame-holder of the invention is formed by a single body 1 having a large prismatic rectangular recess 40 to house the body of a coin or token validation device, not shown, having in one side a first inclined passage or channel 29, provided with side transversal holes 34, for inserting coins or tokens, a second passage or channel 30 for receiving valid-coins and directing them toward a collection tank and a third passage 31 that communicates with a box 32 which is outwardly open, or with a vertical passage 32*a* (FIG. 1*a*). Holes 34 facilitate removal of coins and tokens which may become stuck in passage 29. The dotted line and arrows in this figure show the path along which the coins or tokens run through the validation device and the body 1 depending on whether they are accepted or not. The front edges of the sides forming recess 40 have chamfers 41 defining a mouth or entrance that provides easy entry of the validation device body and notches 13 and grooves 14 for positioning and locking of the validation device which is provided on its sides with side shafts that will remain housed inside the notches and grooves 13 and 14, and retained by elastic locking member 42 fastened with a screw 43 to the external wall of the side of recess 40 and provided with a protuberance 43*a* (see FIG. 4) that remains inserted in a hole 43*b* at the side of the recess 40. The elbowed end of plate 42 is provided with an opening 44 overlapping the entrance of one of the mentioned grooves 14.

The single-part body 1 has flanges 45 and 46 with holes 47, 48 therein to fasten a panel 2 thereto by screws or bolts inserted through holes 47 and 48 and retained by locknuts 3.

The single body has further a side or edge 62 and a flange 64 thereon on which is mounted a stem or shaft 26 (see FIG. 5) extending to outside wall 68 for pivotally mounting a lever 7 to operate the feeding back device of the validation device, the lever being known per se. An opening 66 is provided in the upper side of recess 40 for movement of lever 7 therethrough.

In FIG. 1 it can be seen that the passage 30 for accepting coins has close to one of its sides upright grooves 49 facing each other and an offset 50. Grooves 49 are for guiding an elongated supplemental element or key member 51 of T-shaped cross section. Elongated rib or stem 54 thereon has a width substantially equivalent to that of passageway 30 and side branches or flanges 52 forming the head of the T have a width that slidingly fit in grooves 49. A beading 53 is provided for engaging in offset 50 when supplemental element 51 is fully inserted.

In FIGS. 2 and 3 are shown two supplemental elements 51 with different heights a and b of their elongated ribs 54. Thus is achieved a larger or smaller opening or throttling of passage 30 by fitting of the different elements 51 in the assembly to vary receiving or acceptance of different diameter coins or tokens. In this way, it is guaranteed that the rod or pin of the microswitch mounted in the platform 55 of the body 1 and inserted through arcuate ports 33 of passage 30 is invariably operated by each passing of a coin through passage 30.

In FIG. 1 can also be seen the deep offset 56 having curved sides, together with one of the larger sides of passage 30, designed to allow the introduction therethrough of a lever (not shown) which remains in position at the entrance to passage 30 for allowing the coin to pass but preventing the withdrawal of the coin once it is introduced, such a lever being known per se and incorporated in most of the prior art validation devices.

In FIGS. 1 and 4, it is observed that the back of the recess has a large opening 57 level on one side with one side of the recess 40 and delimited on the three other sides by a narrow frame 58 in such a way that installation and connection of whatever type of validation device that is located in the frame are made much easier.

Figure 5:
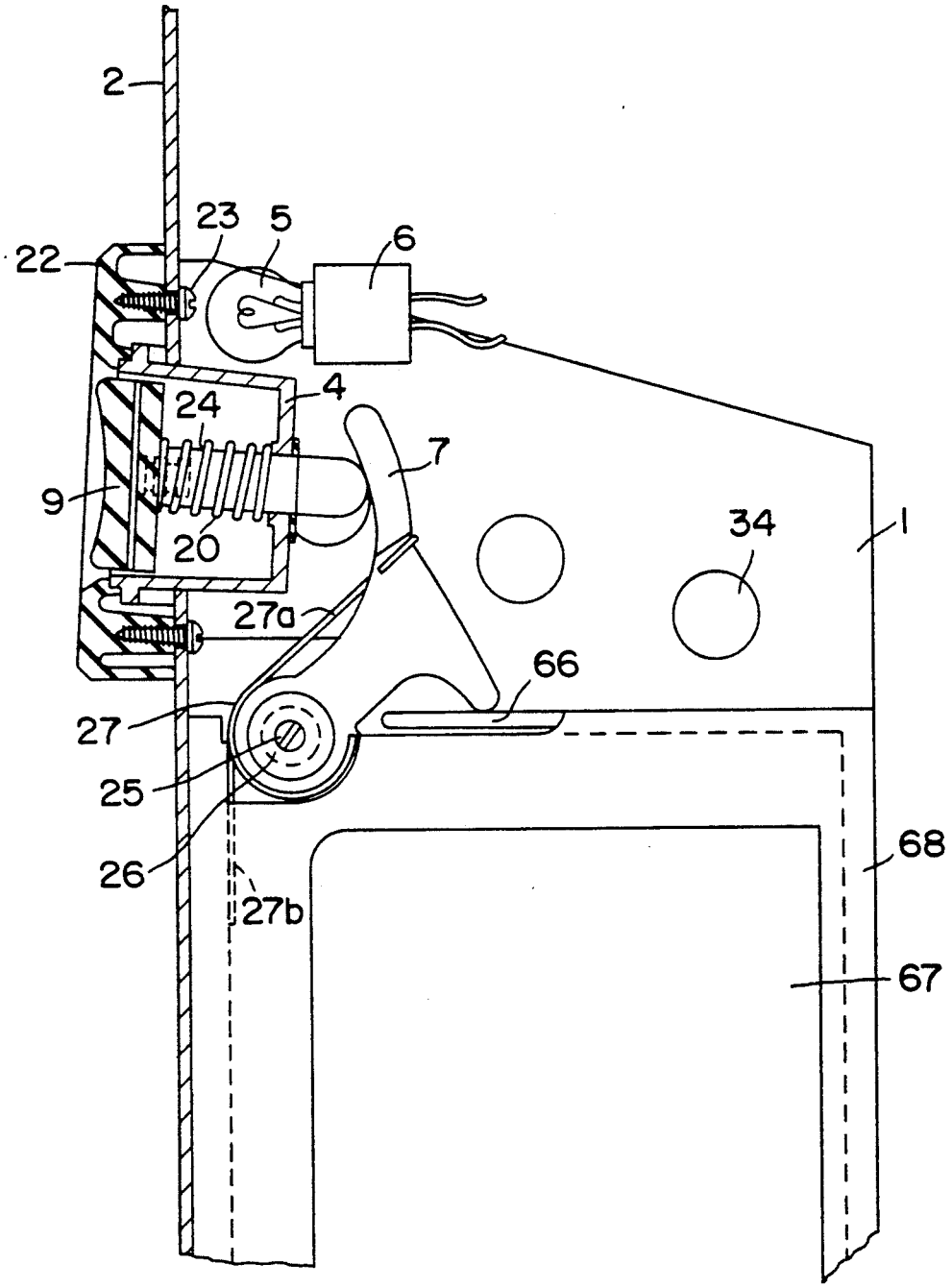
FIG. 5 is a part rear elevation view on a larger scale, of the frame holder, attached to a panel in accordance with FIG. 4.

In FIGS. 4 and 5 there appears the illumination element comprised of a bushing 6 and bulb 5 therein that is removably supported on the frame holder 1 by means of a removable elastic jaw 36 that encloses a protrusion 60 provided with an offset 28. Lever 7 operates a means to feed back the coins jammed into the validation device. Lever 7 is spring loaded by a circular loop spring 27 coaxial with the stem or shaft 26 and having diverging arms 27*a* and 27*b* and is retained by screw 25 in the end of the stem or shaft 26. Arm 27*a* is attached to the lever 7 and arm 27*b* abuts against side wall 62. The frame-holder 1 is associated with panel 2 and a push button 19, spring loaded by spring 20 is mounted therein with its stem 24 facing the lever 7. The push button is mounted in a frame 4 fastened to a second frame 22 which is locked by screws 23 to the panel 2. However in this case the recess bottom is formed by the large opening 57 level with the recess bottom and delimited at its other three sides by a narrow frame 58.

In FIG. 4 are shown hollow protuberances 59 in the back part of the plate 55 designed for mounting the microswitch on plate 55 by lock screws.

The invention, within its scope, can be carried out in other forms or embodiments that differ only in detail from the invention as described by way of example only.

I claim:

1. A holder for coin validation devices comprising:

a one piece injection molded body of plastic material;

a first inclined passage of rectangular cross section in said body for receiving coins and tokens;

a second passage of rectangular cross section having an open end for receiving therethrough accepted coins or tokens;

a third passage of rectangular cross section for receiving rejected coins and tokens and directing said rejected coins or tokens toward a return means;

side walls on said body forming a prismatic substantially rectangular recess in said body having a width an depth and height sufficient to house a validation device for coins and tokens, said three passages each having ends opening into said recess;

means in said body for positioning and locking said validation device within said recess;

means for locking said body at an installation area;

a lever flange protruding from one of said side walls forming said recess and having a stem portion thereon;

a lever rotatably mounted on said stem portion for operating means on the validation device to release jammed coins and tokens therein; and an opening in another one of said side walls forming said recess to facilitate movement of said lever therein.

2. A holder as claimed in claim 1 wherein:

said side walls have front edges;

said means for positioning and locking said validation device in said recess of said body comprise grooves and notches on said front edges of said side walls; and an elastic locking element overlapping one of said grooves.

3. A holder as claimed in claim 2, wherein said locking element comprises:

an entrance portion in said one of said grooves;

a metallic plate element fastened to one of said side walls;

a first end portion on said plate element having an opening and terminating in an elbowed portion overlapping said entrance portion of said one of said grooves;

a hole in said one side wall; and another end portion on said metallic plate element having a protrusion engaging in said hole in said one side wall.

4. A holder as claimed in claim 1 wherein said means for locking said body at an installation area comprises:

laterally extending mounting flanges on one of said side walls and located adjacent to said third passage and said return means; and holes in said flanges for fastening said body to a panel plate.

5. A holder as claimed in claim 2 wherein:

chamfers are provided on said front edges between said grooves and notches forming an entrance mouth for said recess.

6. A holder as claimed in claim 1 and further comprising:

a lower side of said recess defined by a planar part of said body having entrance openings therein for said second and third passage; and a rectangular rear opening in said body at the back of said recess defined on one side by said lower side of said body and on the other three sides by a frame portion on said body.

7. A holder as claimed in claim 1 and further comprising:

a groove in said body having curved concave side portions and extending adjacent to and into said open end of said second passage.

8. A holder as claimed in claim 1 wherein:

said first inclined passage is formed by upper wall portions on said body;

a protrusion means is provided on an upper edge of one of said upper wall portions;

an elastic jaw means is removably attachable to said protrusion means; and an illumination means is attached to said elastic jaw means.

9. A holder as claimed in claim 1 wherein:

said stem portion on said flange extends to an external wall of said body;

a circular loop spring is coaxially mounted on said stem portion and has a first diverging arm attached to said lever and a second diverging arm supported against one of said side walls.

10. A holder as claimed in claim 1 and further comprising:

side members on said body forming said first passage therebetween; and a plurality of holes in said side members of said first passage for removal of coins and tokens stuck therein.

11. A holder for coin validation devices comprising:

a one piece injection molded body of plastic material;

a first inclined passage of rectangular cross section in said body for receiving coins and tokens;

a second passage of rectangular cross section having an open end for receiving therethrough accepted coins or tokens;

a third passage of rectangular cross section for receiving rejected coins and tokens and directing said rejected coins or tokens toward a return means;

side walls on said body forming a prismatic substantially rectangular recess in said body having a width and depth and height sufficient to house a validation device for coins and tokens, said three passages each having ends opening into said recess;

means in said body for positioning and locking said validation device within said recess;

means for locking said body at an installation area;

two elongated grooves in said body facing each other and extending from said open side along one side of said second passage;

an offset cut out in said body adjacent said elongated grooves and said open side;

a set of elongated supplemental key members each having a T-shaped cross section;

a head part on each of said key members having the same size for slidable insertion into said facing grooves;

a rib part on each of said key members for extending into said second passage, said rib parts on different key members having different widths for extending into said second passage different distances for selectively adjusting the size of said second passage for different size coins and tokens; and a bead on one end of each key member for engaging in said offset cut out when said key member is inserted in said grooves.

12. A holder as claimed in claim 11 and further comprising:

a curved profile on said stem part of each key member at said one end thereof adjacent said bead.

13. A holder as claimed in claim 11 and further comprising:

a lever flange protruding from one of said side walls forming said recess and having a stem portion thereon;

a lever rotatably mounted on said stem portion for operating means on the validation device to release jammed coins and tokens therein; and an opening in another one of said side walls forming said recess to facilitate movement of said lever therein.

14. A holder as claimed in claim 11 wherein:

said side walls have front edges;

said means for positioning and locking said validation device in said recess of said body comprise grooves and notches on said front edges of said side walls; and an elastic locking element overlapping one of said grooves.

15. A holder as claimed in claim 14, wherein said locking element comprises:

an entrance portion in said one of said grooves;

a metallic plate element fastened to one of said side walls;

a first end portion on said plate element having an opening and terminating in an elbowed portion overlapping said entrance portion of said one of said grooves;

a hole in said one side wall; and another end portion on said metallic plate element having a protrusion engaging in said hole in said one side wall.

16. A holder as claimed in claim 11 wherein said means for locking said body at an installation area comprises:

laterally extending mounting flanges on one of said side walls and located adjacent to said third passage and said return means; and holes in said flanges for fastening said body to a panel plate.

17. A holder as claimed in claim 13 wherein:

said stem portion on said flange extends to an external wall of said body;

a circular loop spring is coaxially mounted on said stem portion and has a first diverging arm attached to said lever and a second diverging arm supported against one of said side walls.

18. A holder as claimed in claim 11 and further comprising:

a lower side of said recess defined by a planar part of said body having entrance openings therein for said second and third passage; and a rectangular rear opening in said body at the back of said recess defined on one side by said planar part of said body and on the other three sides by a frame portion on said body.

* * * * *